US006507144B1

(12) United States Patent
Jang

(10) Patent No.: US 6,507,144 B1
(45) Date of Patent: Jan. 14, 2003

(54) CATHODE RAY TUBE WITH RECESSION IN THE FUNNEL

(75) Inventor: Hyung Il Jang, Daeku (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/549,466

(22) Filed: Apr. 14, 2000

(30) Foreign Application Priority Data

Apr. 14, 1999 (KR) ..... 99-13158

(51) Int. Cl.[7] ..... H01J 29/70
(52) U.S. Cl. ..... 313/440; 313/477 R
(58) Field of Search ..... 313/440, 477 R; 220/21 A, 21 R

(56) References Cited

U.S. PATENT DOCUMENTS 5,962,964 A * 10/1999 Sano et al. ..... 313/440

FOREIGN PATENT DOCUMENTS

| | | |
|---|---|---|
| JP | 48-34349 | 10/1973 |
| JP | 58-225545 | 12/1983 |

* cited by examiner

*Primary Examiner*—Vip Patel
*Assistant Examiner*—Ken A Berck
(74) *Attorney, Agent, or Firm*—Birch, Stewart, Kolasch & Birch, LLP

(57) ABSTRACT

A cathode ray tube (CRT) having a particular funnel configuration allows electron beams to be deflected to the phosphor surface of the panel without obstruction. The configuration of the yoke attachment portion of the funnel is based upon a curvature of an inner surface of the funnel and based upon a thickness of the funnel. The inner surface of the yoke attachment portion is at a recession from the curvature of the inner surface of the funnel. In one embodiment, if the depth of the recession is S and the thickness of the funnel is T, the recession depth of the inner surface of the yoke attachment portion is $0.1\times Tmm \leqq S \leqq 0.5\times Tmm$.

8 Claims, 6 Drawing Sheets

CATHODE RAY TUBE WITH RECESSION IN THE FUNNEL

BACKGROUND OF THE INVENTION

1. Field of the Invention

The present invention relates to a cathode ray tube such as a color picture tube and a color monitor, and in particular to an improved cathode ray tube which can prevent an interference from taking place to an electron beam deflection trajectory, by sufficiently obtaining the atmospheric pressure resistance of a vacuum vessel, and margin of a beam shadow neck BSN which causes a problem when adjusting a deflection yoke.

2. Description of the Background Art

FIGS. 1 and 2 illustrate an example of a conventional cathode ray tube, respectively. FIG. 1 is a side-sectional view illustrating a color picture tube, and FIG. 2 is a front view illustrating a fluorescent screen provided in a panel.

As shown therein, the cathode ray tube which has been generally known as a Braun tube includes a vacuum vessel 10 having: a glass panel 3 consisting of an image receiving unit 1 similar to a rectangle having a tube axis Z, a horizontal axis X and a vertical axis Y, and a skirt portion 2 provided around the image receiving unit 1; a glass funnel 4 firmly connected to the skirt portion 2, for maintaining a vacuum state in the cathode ray tube; and a cylindrical glass neck 7 connected to an end portion of the glass funnel 4 having a smaller diameter.

A fluorescent screen 5 having dot- or stripe-shaped fluorescent layers of three colors, blue, green and red is disposed at the panel 3.

An electron gun 9 emitting three electron beams 8 is provided in the neck 7. The electron gun 9 is an in-line type electron gun emitting the three electron beams 8 arranged in a line on an identical horizontal surface.

In addition, a yoke mounting portion 11 is disposed at a predetermined portion between the neck 7 and funnel 4 of the vacuum vessel 10. A deflection yoke 6 deflecting the electron beam 8 emitted from the electron gun 9 to the whole screen is mounted on the yoke mounting portion 11, thereby generating a pincushion type horizontal deflection magnetic field and a barrel type vertical deflection magnetic field.

The electron beam 8 emitted from the electron gun 9 is deflected in a horizontal deflection direction X and a vertical deflection direction Y generated by the deflection yoke 6. Accordingly, when reaching to the fluorescent screen 5 through a shadow mask (not shown) distinguishing colors, the three electron beams arranged in a line are concentrated on the whole fluorescent screen 5 without requiring a specific compensating device, and color images are displayed by horizontal and vertical scanning.

The above-described color picture tube is a line type color picture tube of self convergence, and widely practically used.

It is very important to reduce consumption power of the deflection yoke 6 which is a maximum power consumption source in the cathode ray tube such as the color picture tube.

That is to say, it is necessary to increase an anode voltage which finally accelerates the electron beam in order to improve screen luminance, and it is also necessary to increase a deflection frequency so as to correspond to office automation OA apparatuses including a high definition television HDTV and a personal computer PC, which increases deflection power, namely the consumption power of the deflection yoke 6.

Especially when the electron beam is deflected by a high frequency, the deflection magnetic field may be easily externally leaked from the cathode ray tube. Accordingly, restrictions are enhanced in regard to the leakage magnetic field of the cathode ray tube, namely the OA apparatuses such as the personal computer.

In the deflection yoke 6, a method of using a compensating coil as a means for reducing the magnetic field leaked from the cathode ray tube has been generally employed.

However, to use the compensating coil increases the consumption power of the personal computer.

In general, when reducing the deflection power or leakage magnetic field, it is preferable to efficiently operate the deflection magnetic field in regard to the electron beams, by decreasing a diameter of the neck 7 of the cathode ray tube, an outer diameter of the yoke mounting portion 11 on which the deflection yoke 6 is mounted, and an operational space of the deflection magnetic field.

In the above-described cathode ray tube, in case the electron beam 8 is deflected in a direction of a maximum diameter of the screen, namely a diagonal direction, a deflection angle of the electron beam, namely an angle between the tube axis Z and the deflected electron beam 8 is increased.

When the deflection angle of the electron beam 8 is increased, the electron beam 8 passes near the yoke mounting portion 11 of the funnel on which the deflection yoke 6 is mounted.

Accordingly, when the diameter of the neck 7 or the outer diameter of the yoke mounting portion 11 of the funnel 4 is simply decreased, as illustrated in FIG. 1, the outer-side electron beam 8 collides with an inner wall P1 near the neck 7 of the funnel 4. In addition, as illustrated in FIG. 2, a region of the fluorescent screen 5 where the electron beam 8 does not reach, namely a non-luminescence portion P2 is generated.

Therefore, in the conventional cathode ray tube, it is impossible to simply decrease the diameter of the neck 7 or the outer diameter of the yoke mounting portion 11 of the funnel 4. As a result, it is difficult to reduce the deflection power or leakage magnetic filed.

In order to overcome the above-described disadvantage, it is disclosed in Japanese Patent Application 48-34349 a vacuum vessel 20 of the cathode ray tube having a different shape as depicted in FIGS. 3 to 5, based on the fact that a passing region defined according to a trajectory of the electron beam 8 passing the yoke mounting portion 11 near the neck 7 of the funnel 4 forms a shape similar to a rectangle, in the case of drawing a rectangular raster on the fluorescent screen 5.

In the vacuum vessel 20, as shown in FIGS. 4A to 4E taken along lines B—B to F—F, respectively, the sectional shape from the neck 7 of the funnel 4 where the deflection yoke 6 is mounted to the funnel 4 is varied from a round shape to a shape similar to the rectangle via an elliptical shape.

As compared with the vacuum vessel of the cathode ray tube having the round-shaped yoke mounting portion 11 near the neck 7 of the funnel 4, the vacuum vessel 20 has a shape similar to the rectangle.

Accordingly, the horizontal deflection coil and the vertical deflection coil of the deflection yoke are positioned at the passing region of the electron beam 8, and thus the electron beam 8 is efficiently deflected, thereby reducing the deflection power.

However, in the conventional vacuum vessel 20, the sectional shape of the side of the neck 7 of the funnel 4 where the deflection yoke 6 is mounted, namely the sectional shape of the yoke mounting portion 11 forms a shape similar to the rectangle, and accordingly the strength of the inside air pressure is decreased, thereby reducing stability. Thus, it is difficult to sufficiently reduce the deflection power.

On the other hand, in general, the more the deflection angle of the electron beam 8 is increased, the more a length of a tube of the cathode ray tube, namely a length of the whole neck 7 is shortened.

For instance, a deflection tube of 110° has been developed by utilizing enlarged angle deflection. However, in the case that the enlarged angle deflection is simply performed, the deflection angle of a diagonal portion is increased, thereby causing a beam shadow neck BSN.

According to Japanese Patent Application 58-225545, the beam shadow neck BSN is overcome by providing a groove at the diagonal portion in a cone-shaped portion of the funnel.

As described above, in the conventional cathode ray tube, the deflection yoke is designed according to the funnel. However, in a pyramid-shaped funnel and deflection yoke structure, when designing the side of the neck of the funnel, namely the yoke mounting portion, an optimal inside shape is set by considering the trajectory of the electron beam, an explosion proof property and the beam shadow neck BSN. There is a restriction of designing the funnel according to the deflection yoke, as in the order of designing the deflection yoke→modeling the shape of the deflection yoke→computing the magnetic field→analyzing the trajectory of the electron beam→analyzing stress of a funnel bulb→re-designing the deflection yoke. Thus, in a state where a funnel inside numeral is almost set, it is required the optimization of the funnel outside design for improving the strength of the inside air pressure by considering the deflection sensitivity and the explosion proof property.

However, in the conventional cathode ray tube, when the inside shape of the yoke mounting portion where the beam shadow neck BSN is generated is formed according to a deflection center point, it has a constant curvature so long as there is no inflection point.

In the case of the enlarged angle deflection having the shape of the yoke deposition portion of the funnel as described above, when the deflection yoke is adjusted, a slant of the deflection angle of the electron beam is sharply varied, thereby causing the beam shadow neck BSN generating shadow on the screen.

In addition, in order to prevent the beam shadow neck BSN, as disclosed in Japanese Patent Application 58-225545, in the case that a thickness difference of long and short sides and a diagonal portion is excessively set, a maximum vacuum strength (tension strength) is increased at the funnel diagonal portion, and thus explosion may occur during an exhaust process. Besides, a distance between the deflection coil and the electron beam passing region is increased, and accordingly the deflection power is increased. On the other hand, when a thickness ratio of the diagonal portion and the long and short sides is sufficiently set for the explosion proof and the reduction of the deflection consumption power, the beam shadow neck BSN may be generated, thereby weakening strength of the long and short sides.

Especially, in the conventional cathode ray tube, since the beam shadow neck BSN is mostly generated from the deflection center line to the funnel inside diagonal portion, it is difficult to avoid the neck shadow. In addition, there is little margin of the rotation of the deflection yoke in the ITC works (optimizing the screen by adjusting the deflection yoke when mounting the deflection yoke after fabricating the tube). As a result, productivity thereof is reduced.

SUMMARY OF THE INVENTION

Accordingly, it is a primary object of the present invention to provide a cathode ray tube which can sufficiently obtain strength of an inside air pressure of a vacuum vessel, restrict generation of a beam shadow neck BSN by a constant curvature of a yoke mounting portion, and reduce deflection power of a deflection yoke.

It is another object of the present invention to provide a cathode ray tube which can improve deflection sensitivity, by positioning an inner surface of a yoke mounting portion near a trajectory of an electron beam, and forming a predetermined inflection point at the yoke mounting portion.

It is still another object of the present invention to provide a cathode ray tube which can prevent an interference from occurring in regard to a beam deflection trajectory and sufficiently obtain strength of an inside air pressure, when forming a predetermined inflection point at an inner surface of a funnel, and adjusting a deflection yoke.

In order to achieve the above-described objects of the present invention, there is provided a cathode ray tube including: a vacuum envelope having a face panel including a substantially rectangular effective portion having horizontal and vertical axes which cross at right angles and pass a tube axis, a funnel connected to the face panel, a neck connected to a smaller-diameter end of the funnel, and a phosphor screen formed on an inner surface of the effective portion of the face panel, the funnel including a yoke attachment portion extending from the smaller-diameter end connected to the neck toward the face panel; an electron gun arranged within the neck, for emitting an electron beam to the phosphor screen; and a deflection yoke mounted on outer surfaces of the neck and the yoke attachment portion of the funnel, for deflecting the electron beam emitted from the electron gun along the horizontal and vertical axes so as to cause the electron beam to scan the phosphor screen; at least one cross section of the yoke attachment portion, perpendicular to the tube axis, having a substantially rectangular outer contour which includes a pair of first opposed sides that traverse the horizontal axis, and a pair of second opposed sides that traverse the vertical axis, and a substantially rectangular inner contour which includes four corner sides defined by a concave shape toward the tube axis.

In order to achieve the above-described objects of the present invention, there is provided a cathode ray tube wherein an inner surface of a diagonal portion of a yoke mounting portion is inflected in a normal direction, having a predetermined depth and width, when a recession depth is S and a funnel thickness is T, the recession depth of the yoke mounting portion being at the range of $0.1\times T\text{mm} \leqq S \leqq 0.5\times T\text{mm}$, when a recession width is W, the recession width of the yoke mounting portion being at the range of $0.5\ \text{mm} \leqq W \leqq 15.0\ \text{mm}$, and when a deflection center line of an electron gun is R, and a position of an inflection point of the funnel on a tube axis is L, the position of the inflection point being at the range of $R+0.5\ \text{mm} \leqq L \leqq R+20\ \text{mm}$.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

A cathode ray tube in accordance with a preferred embodiment of the present invention will now be described with reference to the accompanying drawings.

Figure 1:
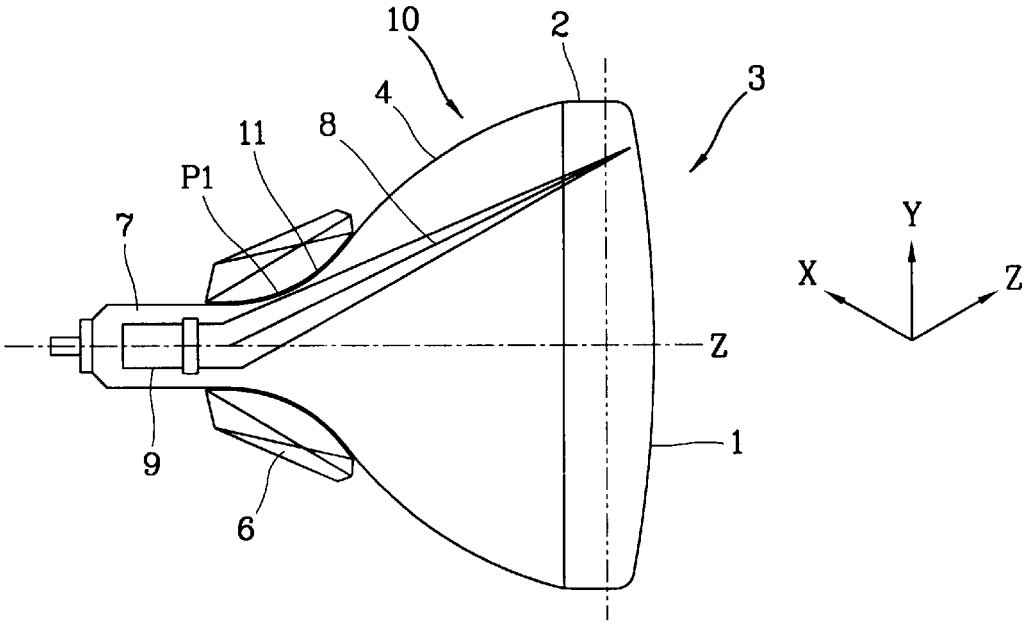
FIG. 1 CONVENTIONAL ART
FIG. 1 is a side-sectional view illustrating a first example of a general cathode ray tube.
Figure 2:
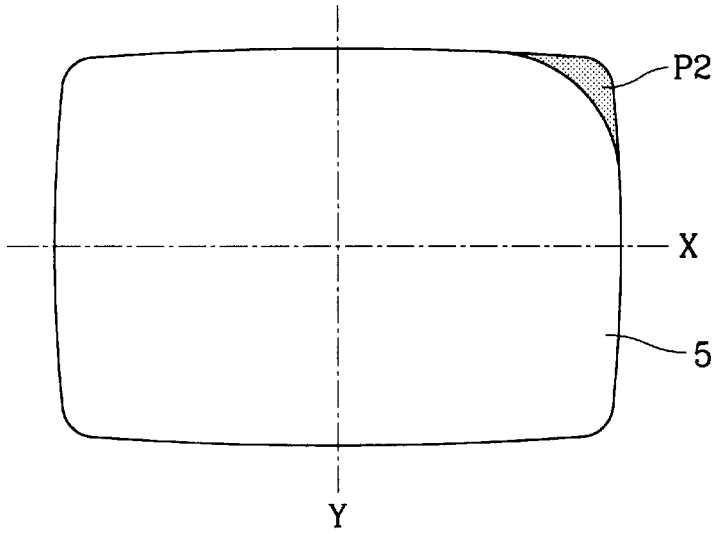
FIG. 2 CONVENTIONAL ART
FIG. 2 is a structure view for explaining an operational space of an electron beam on a fluorescent screen according to the first example of the general cathode ray tube.
Figure 3:
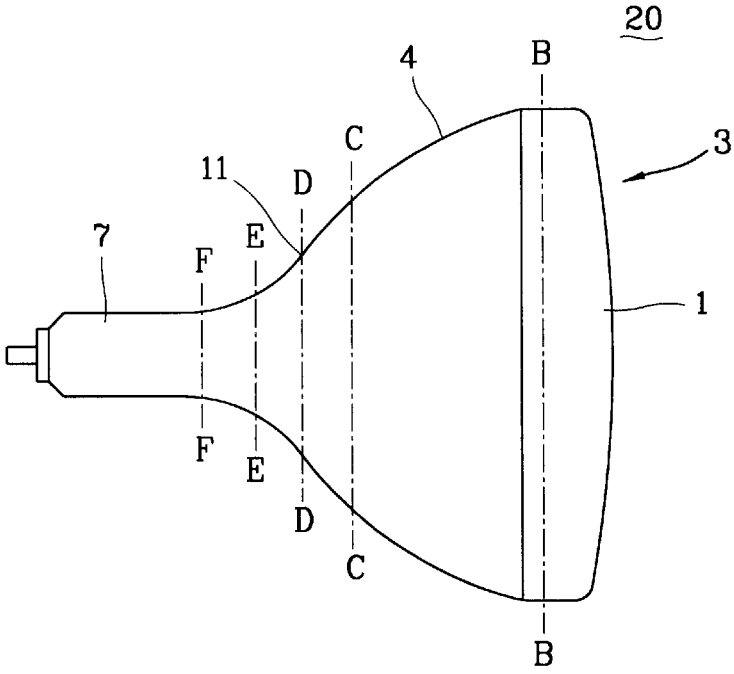
FIG. 3 CONVENTIONAL ART
FIG. 3 is a side-sectional view illustrating a second example of the general cathode ray tube.
Figure 4A:
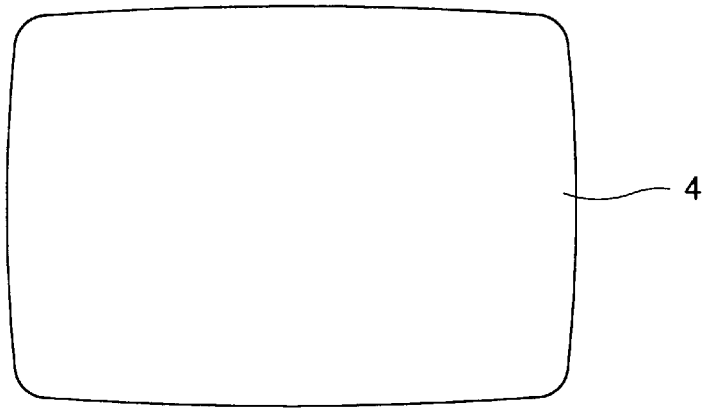
FIG. 4A CONVENTIONAL ART
FIGS. 4A to 4E are front views taken along lines B–B', C–C', D–D', E–E' and F–F', respectively.
Figure 4B:
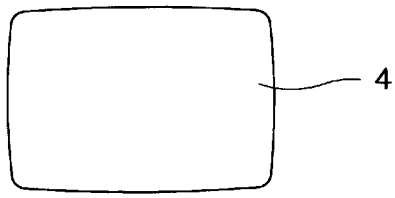
FIG. 4B CONVENTIONAL ART
Figure 4C:
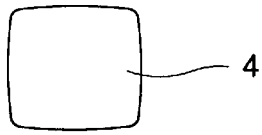
FIG. 4C CONVENTIONAL ART
Figure 4D:
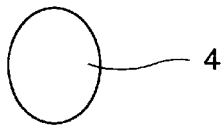
FIG. 4D CONVENTIONAL ART
Figure 4E:
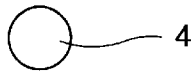
FIG. 4E CONVENTIONAL ART
Figure 5:
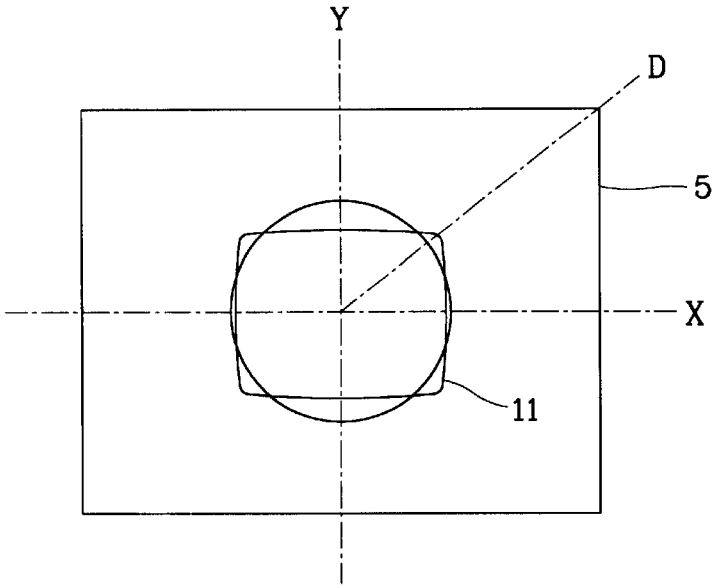
FIG. 5 CONVENTIONAL ART
FIG. 5 is an explanatory view illustrating a third example of the general cathode ray tube, for explaining an relationship with a electron beam passing region, when a yoke mounting portion where a deflection yoke is mounted forms a shape similar to a rectangle.
Figure 6:
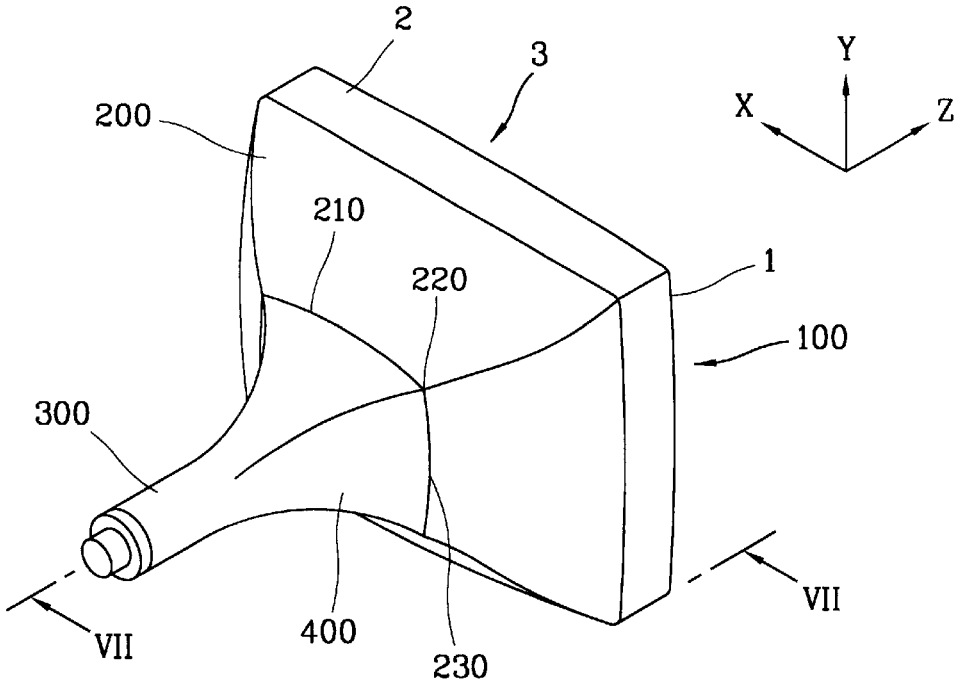
FIG. 6 is a rear perspective view illustrating a cathode ray tube in accordance with the present invention.
Figure 7:
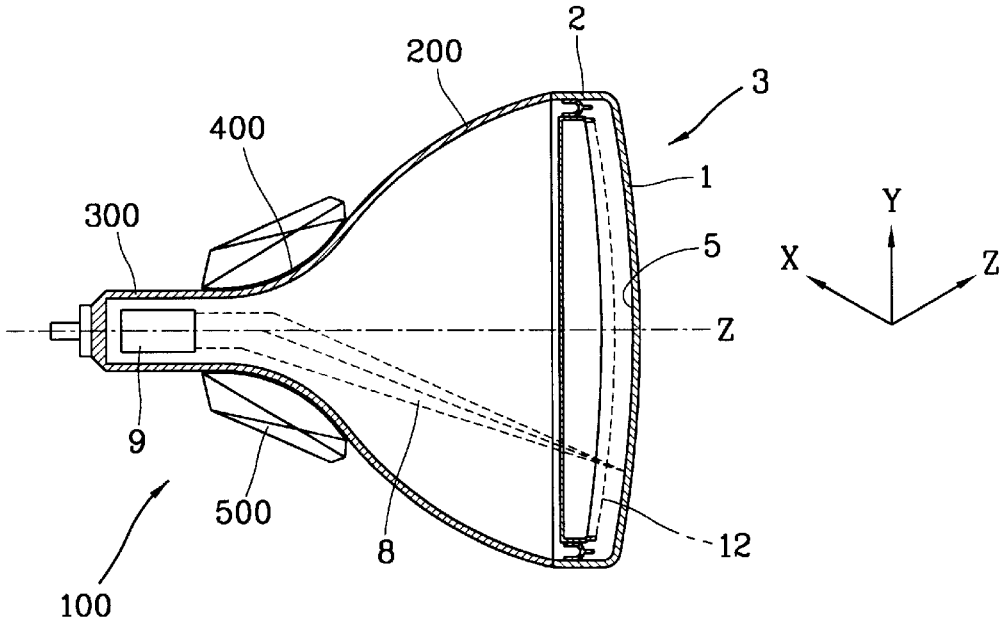
FIG. 7 is a side-sectional view illustrating the cathode ray tube in accordance with the present invention.
Figure 8:
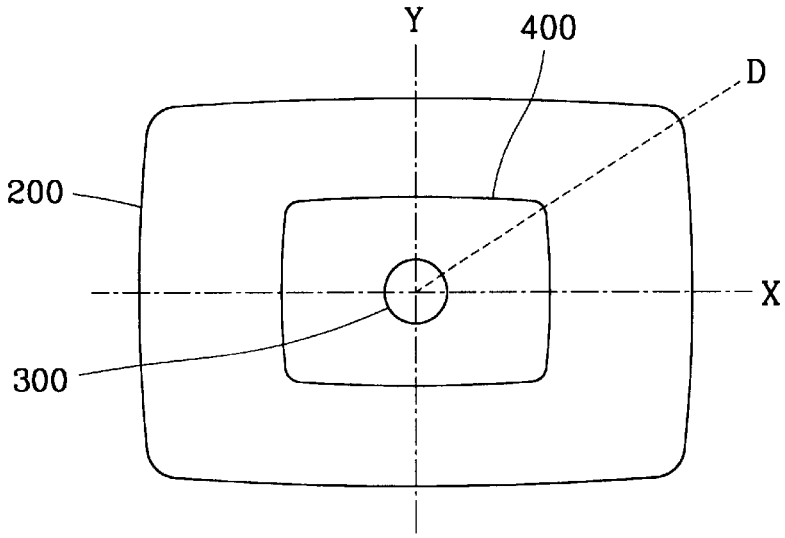
FIG. 8 is a front-sectional view illustrating a funnel of the cathode ray tube in accordance with the present invention.

FIG. 6 is a rear perspective view illustrating the cathode ray tube in accordance with the present invention, FIG. 7 is a side-sectional view illustrating the cathode ray tube in accordance with the present invention, and FIG. 8 is a front-sectional view illustrating a funnel of the cathode ray tube in accordance with the present invention.

The cathode ray tube according to the present invention includes: a vacuum vessel 100 having: a glass panel 3 including an image receiving unit 1 similar to a rectangle having a tube axis Z, a horizontal axis X and a vertical axis Y, and a skirt portion 2 provided around the image receiving unit 1; a pyramided glass funnel 200 firmly connected to the skirt portion 2, for maintaining a vacuum state in the cathode ray tube; and a tube-shaped glass neck 300 connected to an end portion of the glass funnel 200 having a smaller diameter.

A fluorescent screen 5 having dot- or stripe-shaped fluorescent layers of three colors, blue, green and red is provided in the panel 3.

An electron gun 9 emitting three electron beams 8 is disposed at the neck 300. The electron gun 9 is an in-line type electron gun for emitting the three electron beams 8 arranged in a line on an identical horizontal surface.

In addition, a yoke mounting portion 400 is disposed at a predetermined portion between the neck 300 and funnel 200 of the vacuum vessel 100. A deflection yoke 500 deflecting the electron beam 8 emitted from the electron gun 9 to the whole screen is mounted on the yoke mounting portion 400, thereby generating a pincushion type horizontal deflection magnetic field and a barrel type vertical deflection magnetic field.

The electron beam 8 emitted from the electron gun 9 is deflected in a horizontal deflection direction X and a vertical deflection direction Y generated by the deflection yoke 500. Accordingly, when reaching to the fluorescent screen 5 through a shadow mask 12 distinguishing colors, the three electron beams arranged in a line are concentrated on the whole fluorescent screen 5, and color images are displayed by horizontal and vertical scanning.

The yoke mounting portion 400 of the funnel 200 on which the deflection yoke 500 is mounted will now be described in more detail with reference to FIGS. 9 and 10.

Figure 9:
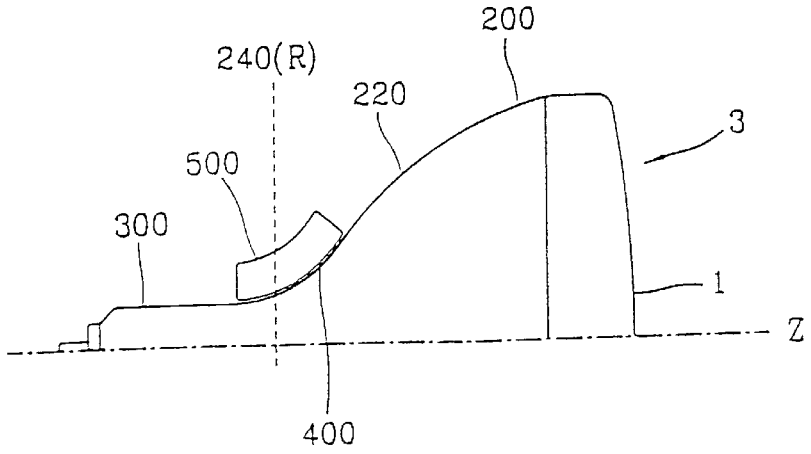
FIG. 9 is a side-sectional view illustrating an upper half portion of the cathode ray tube on a tube axis in accordance with the present invention.
Figure 10:
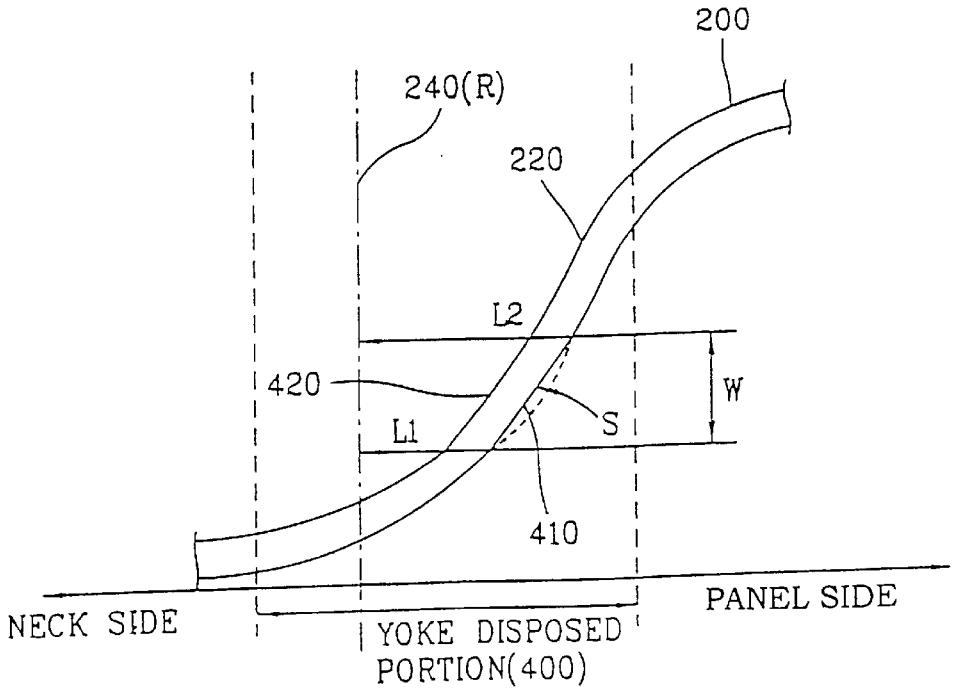
FIG. 10 is an enlarged structure view illustrating a yoke mounting portion of the cathode ray tube in accordance with the present invention.

FIG. 9 is a side-sectional view illustrating an upper half portion of the cathode ray tube on the tube axis in accordance with the present invention, and FIG. 10 is an enlarged structure view illustrating the yoke mounting portion of the cathode ray tube in accordance with the present invention.

The deflection yoke 500 mounted on the yoke mounting portion 400 is a saddle type having a less leakage magnetic field. Here, a vertical deflection coil, a horizontal deflection coil and a core are fixed to a tube-shaped synthetic resin frame.

The yoke mounting portion 400 is almost pyramid-shaped. That is, the section vertical to the tube axis Z is round-shaped at a connection portion with the neck 300, and is almost rectangular at a center portion and around the panel 200, similarly to the image receiving unit 1 of the panel 3, as shown in FIGS. 6 and 8.

Especially, an outer surface of the funnel 200 of the vacuum vessel 100 is concave from the neck 300 to the yoke mounting portion 400, and gradually convex from the yoke mounting portion 400 to the image receiving unit 1, along the tube axis Z, thereby forming a slow S-shape.

Here, the inflection points of the funnel 200 are a long side inflection point 210, a diagonal inflection point 220 and a short side inflection point 230 in regard to the horizontal axis X, the diagonal axis D and the vertical axis Y. The yoke mounting portion 400 has an inner diameter in the horizontal, vertical and diagonal axis X, Y, D directions in regard to coordinates in the tube axis Z direction, respectively.

On the other hand, a thickness of the yoke mounting portion 400 is generally represented by a difference between an inner diameter and an outer diameter in the diagonal, horizontal and vertical axis D, X, Y directions on a deflection reference line 240, namely on the tube axis Z which corresponds roughly to the deflection center.

In addition, in the general vacuum vessel, a maximum vacuum stress is a maximum stress at the whole region of the yoke mounting portion. In the case of the vacuum vessel 100 according to the present invention, a maximum stress is generated in a tension direction at the yoke mounting portion 400 positioned in front of the deflection reference line 240.

Especially, as illustrated in FIG. 10, in order to obtain margin of the beam shadow neck BSN which causes a problem when adjusting the deflection yoke 500 at the yoke mounting portion 400 for the color cathode ray tube, a recession portion 410 inflected in the normal direction of the funnel 200, having a predetermined depth and width at a predetermined position from the deflection reference line 240 to the image receiving unit 1 is formed at the yoke mounting portion 400 where the beam shadow neck BSN may occur.

Accordingly, the yoke mounting portion 400 includes an enhancing portion 420 protruded from the tube axis Z as far as a recession depth and width of the recession portion 410, for reducing the maximum stress applied to the funnel 200.

Here, when it is presumed that the recession depth of the recession portion 410 is S, the width thereof is W, and the thickness thereof is T, the recession depth is at the range of $0.1\times Tmm \leqq S \leqq 0.5\times Tmm$, and the recession width is at the range of $0.5\ mm \leqq W \leqq 15.0\ mm$.

In case the recession depth is below 0.1 Tmm, it is difficult to avoid the beam shadow neck BSN. When the recession depth is over 0.5 Tmm, the inside air pressure has a problem.

Besides, in case the recession width is below 0.5 mm, it is hard to avoid the beam shadow neck BSN due to blocking during a graphite coating process. When the recession width is over 15 mm, it is difficult to obtain the strength of the inside air pressure.

As a result, the recession depth S and width W are preferably set at the aforementioned ranges.

The recession portion 410 to be inflected exists between the diagonal inflection point 220 on the diagonal axis D having a great deflection angle and the deflection reference line 240. In the inner surface shape of the recession portion 410 of the yoke mounting portion 400, the inflection point of the recession portion 410 has a recession starting position L1 and a recession ending position L2 which are close to and far from the deflection reference line 240, respectively.

At this time, the recession starting position L1 approximately has 5.0 mm from the deflection reference line 240 to the image receiving unit 1, and the recession ending position L2 approximately has 20 mm from the deflection reference line 240 to the image receiving.

That is, when it is presumed that the deflection reference line is R and the position of the inflection point of the recession portion 410 is L, the position of the inflection point of the recession portion 410 is preferably at the range of $R+0.5\ mm \leqq L \leqq R+20\ mm$. In this case, the yoke mounting portion 400 has the recession portion 410 inflected in the normal direction of the funnel 200, thereby increasing the redundancy when adjusting the deflection yoke 500. At the same time, the deflection sensitivity is improved without increasing the outer surface radius of the yoke mounting portion 400. In addition, the maximum stress by the air pressure is efficiently decreased by the enhancing portion 420 of the yoke mounting portion 400.

As discussed earlier, the cathode ray tube in accordance with the present invention forms the recession portion at the inner surface of the yoke mounting portion where the deflection yoke is mounted, thereby obtaining the margin of the beam shadow neck BSN, and preventing the interference from occurring in regard to the electron beam deflection trajectory.

Moreover, the enhancing portion is formed at the outer surface corresponding to the inner surface of the yoke mounting portion, thereby optimizing the stress of the funnel. As a result, the inside air pressure strength and the deflection sensitivity of the vacuum vessel are improved.

As the present invention may be embodied in several forms without departing from the spirit or essential characteristics thereof, it should also be understood that the above-described embodiment is not limited by any of the details of the foregoing description, unless otherwise specified, but rather should be construed broadly within its spirit and scope as defined in the appended claims, and therefore all changes and modifications that fall within the metes and bounds of the claims, or equivalences of such metes and bounds are therefore intended to be embraced by the appended claims.

What is claimed is:

1. A cathode ray tube comprising:

a vacuum envelope having a face panel including a substantially rectangular effective portion having horizontal and vertical axes which cross at right angles and pass a tube axis, a funnel connected to the face panel, a neck connected to a smaller-diameter end of the funnel, and a phosphor screen formed on an inner surface of the effective portion of the face panel, the funnel including a yoke mounting portion extending from the smaller-diameter end connected to the neck toward the face panel;

an electron gun arranged within the neck, for emitting an electron beam to the phosphor screen; and a deflection yoke mounted on an outer surface of the neck and the yoke mounting portion of the funnel, for deflecting the electron beam emitted from the electron gun along the horizontal vertical axes so as to cause the electron beam to scan the phosphor screen;

at least one cross section of the yoke mounting portion, perpendicular to the tube axis, having a substantially rectangular outer contour which includes a pair of first opposed sides that traverse the horizontal axis, and a pair of second opposed sides that traverse the vertical axis, and a substantially rectangular inner contour which includes four corner sides formed by a recessed portion with a certain width and depth toward the tube axis in outward direction, wherein, when a depth of the recessed portion is S and a thickness of the funnel is T, the recessed depth of the inner surface of the yoke mounting portion is at the range of $0.1\times T\ mm \leqq S \leqq 0.5\times T\ mm$.

2. The cathode ray tube according to claim 1, wherein, when a width of the respectively recessed and protruded portion is W, the respectively recessed and protruded width of the inner and outer surface of the yoke mounting portion is in the range $0.5\ mm \leqq W \leqq 15.0\ mm$.

3. The cathode ray tube according to claim 1, wherein, when a deflection center line of an electron gun is R and a position of an inflection point of the funnel on the tube axis is L, the position of the inflection point is at the range of $R+0.5\ mm \leqq L \leqq R+20\ mm$.

4. A cathode ray tube comprising:

a vacuum envelope having a face panel including a substantially rectangular effective portion having horizontal and vertical axes which cross at right angles and pass a tube axis, a funnel connected to the face panel, a neck connected to a smaller-diameter end of the funnel, and a phosphor screen formed on an inner surface of the effective portion of the face panel, the funnel including a yoke mounting portion extending from the smaller-diameter end connected to the neck toward the face panel;

an electron gun arranged within the neck, for emitting an electron beam to the phosphor screen; and a deflection yoke mounted on an outer surface of the neck and the yoke mounting portion of the funnel, for deflecting the electron beam emitted from the electron gun along the horizontal vertical axes so as to cause the electron beam to scan the phosphor screen;

wherein an inner surface of the yoke mounting portion is recessed in a direction normal thereto and a corresponding outer surface of the yoke mounting portion is correspondingly protruded in a direction normal thereto by a predetermined depth over a predetermined width at positions thereof between a deflection reference plane of the funnel and diagonal inflection points on a diagonal axis of the funnel.

5. The cathode ray tube according to claim 4, wherein, when a depth of the recessed portion is S and a thickness of the funnel is T, the respectively recessed and protruded depth of the inner and outer surface of the yoke mounting portion is in the range $0.1 \times T$ mm$\leqq S \leqq 0.5 \times T$ mm.

6. The cathode ray tube according to claim 4, wherein, when a width of the respectively recessed and protruded portion is W, the respectively recessed and protruded width of the inner and outer surface of the yoke mounting portion is in the range 0.5 mm$\leqq W \leqq$15.0 mm.

7. The cathode ray tube according to claim 4, wherein, when a deflection center line of an electron gun is R and a position of an inflection point of the funnel on the tube axis is L, the position of the inflection point is at the range of R+0.5 mm$\leqq L \leqq$R+20 mm.

8. A funnel for a cathode ray tube having a yoke mounting portion for mounting a deflection yoke thereon, wherein an inner surface of the yoke mounting portion is recessed in a direction normal thereto and a corresponding outer surface of the yoke mounting portion is correspondingly protruded in a direction normal thereto by a predetermined depth over a predetermined width at positions thereof between a deflection reference plane of the funnel and diagonal inflection points on a diagonal axis of the funnel.

* * * * *